US005261130A

United States Patent [19]

Kendall

[11] Patent Number: 5,261,130

[45] Date of Patent: Nov. 16, 1993

[54] SPACER FOR SUPPORTING WATER CATCHMENT BASINS

[76] Inventor: Desmond M. Kendall, 121 Brillinger St., Richmond Hill, Ontario L4C 8X8, Canada

[21] Appl. No.: 861,440

[22] Filed: Apr. 1, 1992

[51] Int. Cl.[5] ..... A47K 3/02

[52] U.S. Cl. ..... 4/613; 4/593

[58] Field of Search ..... 4/251.1, 251.2, 546, 4/592, 613, 595, 538, 548, 597, 613, 637, 641, 593; 206/520, 516; 180/68.5; 280/18, 28

[56] References Cited

U.S. PATENT DOCUMENTS

| | | | |
|---|---|---|---|
| 3,561,019 | 2/1971 | Roland | 4/593 |
| 3,606,617 | 9/1971 | Frazier | 4/613 |
| 4,142,634 | 3/1979 | Leff et al. | 206/516 |

FOREIGN PATENT DOCUMENTS

| | | | |
|---|---|---|---|
| 676332 | 7/1952 | Belgium | 180/68.5 |
| 49004 | 4/1990 | European Pat. Off. | 4/593 |
| 94446 | 6/1896 | Fed. Rep. of Germany | 4/546 |

*Primary Examiner*—Henry J. Recla
*Assistant Examiner*—Charles R. Eloshway
*Attorney, Agent, or Firm*—Trevor C. Klotz

[57] ABSTRACT

A spacer for positioning between the underside of a water catchment basin, such as a bathtub or shower pan is disclosed. The upper surface of the spacer is contoured so as to receivingly engage the underside of the basin and has a thickness dimension so as to maintain the underside of the basin a fixed distance above a horizontal plane, such as a floor. The spacer may be affixed to the underside of the basin at the time of construction or alternatively, separately suppled for field use at the time the basin is installed. If the perimeter of the spacer corresponds to the smallest interior dimension of the basin, identical basins with identical spacers attached thereto can be stacked one on top of the other for shipping purposes. The spacer can also be provided with channel or cavity sections which facilitate the placement therein of air or water supply conduit for the basin, if desired.

7 Claims, 3 Drawing Sheets

SPACER FOR SUPPORTING WATER CATCHMENT BASINS

FIELD OF THE INVENTION

This invention relates to a novel spacer for supporting a water catchment basin and the novel spacer in combination with a water catchment basin. The spacer of this invention is ideally suited for catchment basins of the type used in personal washing hygiene such as bathtubs, spas, hot tubs, shower tubs or stalls, and the like.

Most water catchment or containment basins of the foregoing description normally have a relatively flat bottom portion in the basin and which, relative to a horizontal base, is inclined for the purpose of draining collected water therefrom. One type of conventional basin is the metal bathtub which is used in alcove installations. It is normally floor supported on its face or exterior side by means of an integral metal face plate which extends downwardly to the floor from the rim or upper shoulder area of the tub. Additional support for the basin is achieved by positioning, at a predetermined elevation from the floor, bracing members which are normally attached to the three walls of the alcove, and which support the underside of the basin in its rim or top area. In other words no direct support is imparted to the inclined flat bottom portion of the basin unless filler pieces, such as wooden wedges or the like, are employed.

Thermoformed plastic catchment basins such as acrylic bathtubs and shower pans in the inclined flat bottom portion thereof, when installed in alcoves or in a free standing position, invariably require additional support at least on the underside of its generally flat bottom to prevent or minimize flexing of the plastic tub when charged with water or subjected to additional loading by the body weight of users of the tub. The side walls and bottom of a basin which has been the subject of deep draw thermoforming are thinned out and thus less rigid.

The required bottom support is normally achieved by providing factory installed spacers on the underside of the flat bottom basin portion of the thermoplastic tub. These spacers, which are commonly in the form of wooden wedges glued to the underside of the basin, are not always in perfect alignment and can cause unwanted difficulties to the installer endeavouring to ensure that the plane of the upper surface of the water containment vessel is horizontal, and that the bottom of the basin is properly and fully supported from below.

Not uncommonly, plastic tubs which include factory installed spacers, also include a wooden framework or glass fiber reinforcement for supporting other underside areas of a tub, such as the underside of the top or rim area of the tub. This type of additional framework on the underside of the tub precludes identical types of tubs from being nestingly stocked one on top of the other and thus necessitate individual tub packaging and shipping. Even without an added framework or reinforcement, and even if one of these types of basins could be nestingly stacked on top of an identical basin, stacking could not be undertaken without first ensuring the roughly finished underside of the top basin does not abrade or damage the interior surf ace of the lower basin.

Some commerically available plastic tubs on the market are not supplied with factory installed basin support spacers but may include a face panel similar to that earlier described in connection with metal bathtubs. As they both look similar to an installer, the installer may elect to not support the plastic tub from below based on the mistaken belief that there is sufficient support for the tub if, in addition to the face plate, it is supported by bracers attached to the walls of the alcove into which it is positioned. Moreover, if the tub is supplied with an integral exterior face plate or supporting wall, in alcove installations, because the underside view of the basin is blocked from view as the tub is being installed in the alcove, the installer can never be certain that spacers, such as wooden wedges, if put into position by the installer, or factory, in advance of the alcove installation of the tub, are in fact in proper supporting contact with the basin underside and its supporting floor.

A further shortcoming when using wooden wedges as a support for the undersurface of a basin or in the construction of a larger supporting framework for the basin undersides is that, unless the wooden members are suitably sealed or encapsulated, they may rest in a potentially wet or a high humidity environment, and over time, will rot and no longer function in the manner initially intended.

SUMMARY OF INVENTION

The novel spacer of this invention may be used with water catchment basins of the foregoing description and if desired, can be physically attached to the basin underside at the time of production, or optionally, can be supplied separately for on site installation. In either case, the spacer ensures that the bottom of the basin is maintained at a fixed and supported position above a floor on which the basin rests. Additionally, the spacer may also support, from below, the lower portion of the thin plastic sidewalls which curve upwardly from the flat bottom of the basin.

Advantageously, the spacer can be of unitary construction and is preferably formed from a suitable plastics material, such as polyvinyl chloride (PVC) which impervious to water or moisture.

In accordance with yet another feature of this invention, the underside of the spacer can be provided with a cavity section for the purpose of locating air and/or water supply conduit therein, and which in turn can be used as a supply line for discharge openings in the relatively flat bottom portion of the basin. If desired, the cavity in the spacer can also accommodate insulation material, such as urethane foam, for the purpose of heat retention or added reinforcement. Moreover, the spacer can also act as a moisture or condensation collector, and thus avoid or minimize unwanted water seepage onto the floor adjacent the basin.

In accordance with yet another preferred form of construction, the size of the spacer as determined by its exterior side wall can be dimensioned so as to fit internally of the same type of basin which it is intended to support. This permits one basin to be nestingly stacked on top of another, substantially identical basin, with the spacer supporting the underside of the top basin and also functioning in a manner to restrict the underside of the top basin from touching or abrading the inner surface of the lower basin. By facilitating the stacking of two or more basins in this manner, bulk shipping costs can be materially reduced when compared to the costs incurred in packaging and shipping a basin of the type described herein, on a single item basis.

In keeping with an additional feature of this invention, the spacer can also advantageously include mounting means for supporting an air or water circulation pump thereon in a fixed location, and which relative to the underside flat portion of the basin which the spacer is intended to support, is exterior of the flat portion. This feature facilitates, if desired, field installation of water and air injection equipment on the spacer for the water containment basin, and avoids the need to have this type of equipment installed at the production site. It is also possible to locate depressions, such as channels, in the upper surface of the support, and which serve to reinforce the support. By locating these depressions or channels below the water pump, its associated couplings or conduits, the channels can also act as direct water drip collectors for these items. Moreover, the channels or depression in the spacer or cradle also assist in reducing or damping noise and vibrations imparted to the tub by the water circulation or air supply pumps which are conveniently attached to the spacer.

In accordance with the foregoing, the novel spacer of this invention and as used for supporting a water catchment basin in a predetermined position above a horizontal base, is of unitary construction and dimensioned so as to underlie at least a relatively flat bottom portion of the basin. The spacer is provided with major top and bottom exterior surfaces, with a central contact area located on the top surface that is contoured or profiled so as to receivingly engage the flat bottom portion of the basin. The top surface may optionally also include a perimeter area, at least a portion of which is contoured to further receivingly engage the underside of the basin. A bottom contact area is located on the bottom surface of the spacer and is intended to engage a horizontal base such as a floor on which the spacer rests. Suitable means, such as the composition of material making up the body of the spacer itself, or webs, are employed for maintaining the central and perimeter areas in fixed spaced apart relationship relative to the bottom area. This enables a specific spacer to be constructed for common use with a given basin configuration, and ensures fast and easy on site levelling of the basin, relative to a horizontal base, on which it is mounted.

For the purpose of weight and cost of materials savings as well as optionally accommodating plumbing or air supply equipment for the supported basin, the central and the perimeter areas, if included, are preferably held in fixed spaced apart relationship from the bottom area by a plurality of webs which interconnect the central and perimeter areas to the base area. Moreover, and advantageously, the webs can be arranged in spaced apart pairs so as to form in the spacer, a plurality of elongate channels in the exterior top surface of the central area of the spacer and which also impart to the spacer improved load strength. Similarly, a further pair of spaced apart webs may also be disposed between the central area and the perimeter area of the spacer, if included, so as to again form in its top surface, a perimeter channel extending fully or partly about the spacer. In order to maintain the central and perimeter areas at a fixed distance from the bottom area of the spacer, the channels extend substantially the full depth of the spacer such that the bottom surface of the spacer created by the channels functions as the bottom contact area of the spacer which engages a horizontal base, such as a flat floor.

The utilization of reinforcing channels which appear as depressions or channels on the top surface of the spacer form a cavity area in the bottom of the spacer. The cavity so created preferably is of a depth sufficient to accommodate conduit positioned therein and which is used for supplying pressurized air or water, or both, to the flat bottom portion of the basin through aligned apertures located in the central area of the spacer and in the basin itself.

In order to permit substantially identical water catchment or containment basins to be stacked one on top of the other, and in order to avoid the underside of the upper basin from scraping or abrading the inner finished surface of the basin which it overlies, the spacer, which, if desired, can be physically bonded to the underside of this type of stackable basin using any type of suitable adhesive, has its exterior side wall configured to impart a dimension to it which enables the spacer and an accompanying basin to be receivingly positioned in the interior of an identical basin located therebelow; the spacer effectively supporting and maintaining the side walls of each nested basin apart from one another. When used in nesting applications as described, the spacer must necessarily effectively only underlie the relatively flat bottom portion of its associated type of water catchment basin. However, in other applications, the spacer can be oversized to impart to it further versatility as described above.

Whether or not the spacer is bonded to the basin, it will be recognized that various apertures in the spacer to accommodate, say, the water discharge pipe for the basin or passageways for air and water inlets to the basis bottom, can be predrilled, or their hole locations on the spacer otherwise marked, preferably on the bottom surface of the spacer, all for the purpose of aligning the location of these apertures with apertures in the basin.

LIST OF DRAWINGS

In the accompanying drawings which illustrate several embodiments of this invention:

DESCRIPTION OF PREFERRED EMBODIMENTS

Figure 1:
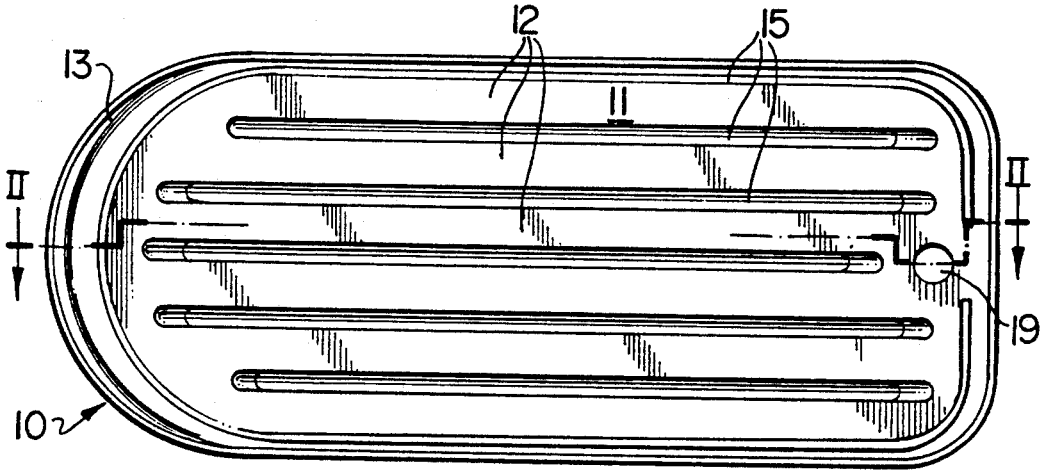
FIG. 1 is a top plan view of a spacer which is also dimensioned for use in basin nesting applications.
Figure 2:
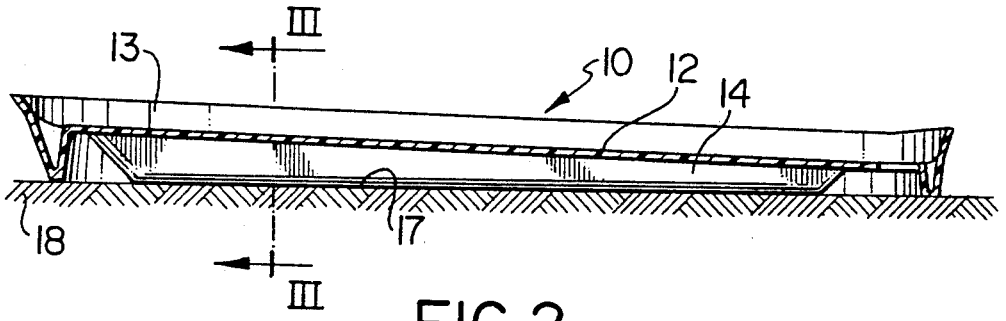
FIG. 2 is a cross sectional view of the spacer taken along line II—II of FIG. 1.
Figure 3:
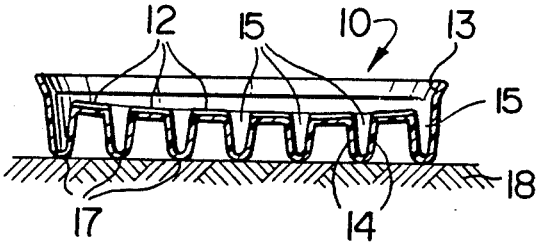
FIG. 3 is a cross sectional view of the spacer taken along line III—III of FIG. 2.

For ease of understanding, and where possible to do so, in the drawings, the same reference number has been used to identify the same parts or features.

Figure 4:
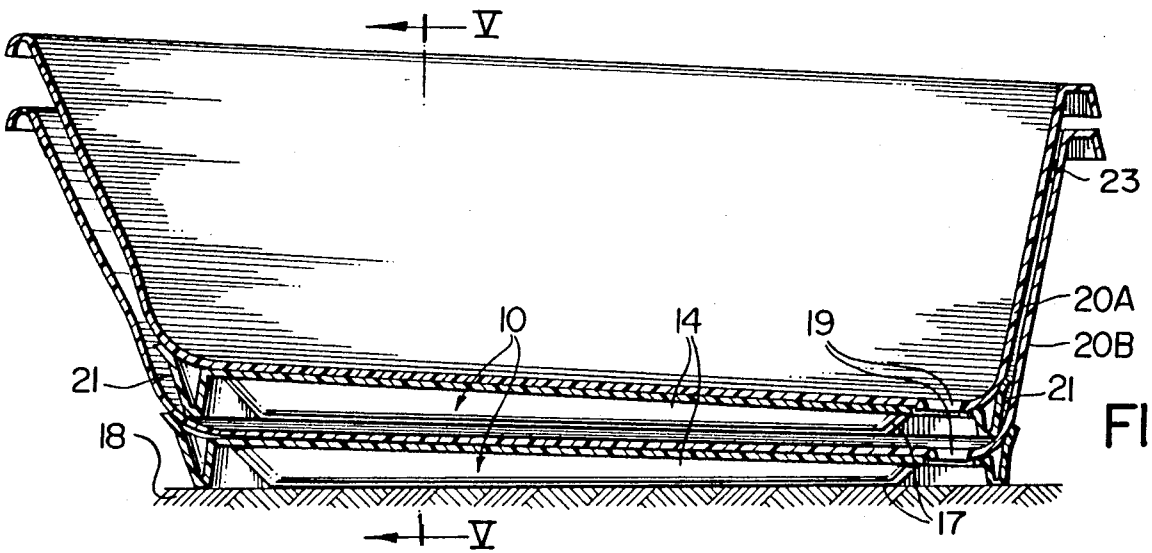
FIG. 4 is a similar cross sectional view to that of FIG. 2, but also shows two spacers and their accompanying basins when in a nested condition.
Figure 5:
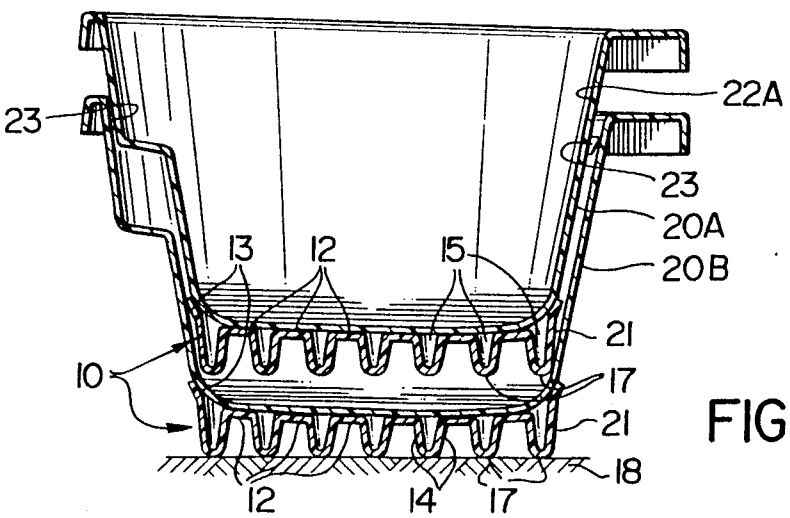
FIG. 5 is a cross sectional view of the nested basins and spacers taken along line V—V of FIG. 4.

Referring firstly to the support generally indicated by arrow 10 in FIGS. 1 through 6, it is of unitary construction and preferably made from formed or molded plastics material such as, for example, polyvinyl chloride or ABS resin. Its major top surface generally indicated as 11 in FIG. 1, includes a central contact area 12 which as illustrated, is contoured to underlie the relatively flat bottom portion of a bathtub as discussed in greater detail below. The top surface of the spacer also includes a perimeter contact area 13 which serves to centralize the underside of a tub basin positioned thereover and to positivelly engage and support the lower upwardly curved sidewalls of the basin as best seen in FIG. 5.

Pairs of spaced apart webs 14 create channel depressions 15 in the top surface 11 of the support; parallel channel depressions being seen in the central contact area 12 and a perimeter channel depression being located between the central and peripheral contact areas 12 and 13. These channel depressions 15, on the major bottom surface of the support, collectively constitute the bottom contact area 17 of the support which rests on horizontal plane 18, such as a bathroom floor. As illustrated, the support also includes a waste water drain aperture 19.

As will be apparent from that which follows, at least the central contact area 12 of the support can be either bonded to the underside of a basin which compliments its top surface profile either at the manufacturing source or in the field. Alternatively, because the top surface of the support is designed to mate with the underside of the basin, bonding of the two together can be dispensed with. However, if the two are bonded together, the parallel channel depressions 15 in the central contact area 12, together with the underside of the basin effectively become closed chambers and can, if desired, be utilized as air or water circulation supply chambers, which, together with overlying apertures in the relatively flat bottom portion of the basin (not shown), provide communication between these channels or chambers and the basin interior.

Referring now to FIGS. 4 and 5, basins 20A and 20B as illustrated are "flush mounted" bathtubs, and excluding the illustrated supports, are of a type as is well known in the art. As shown, supports 10 which are identical in size and shape, have been respectively bonded to the relatively flat bottom portion of basins 20A and 20B. The exterior side walls 21 of the spacers supporting these basins are of a size and dimension to be received in the interior of a basin which it overlies. While the spacer attached to overlying basin 20A maintains its sidewall 22A in spaced relationship from underlying sidewall 22B of basin 20B, in order to avoid or reducing abrasion or scuffing between these sidewalls at their upper extremities, suitable separation material such as cardboard can be positioned between them as illustrated at 23.

Figure 6:
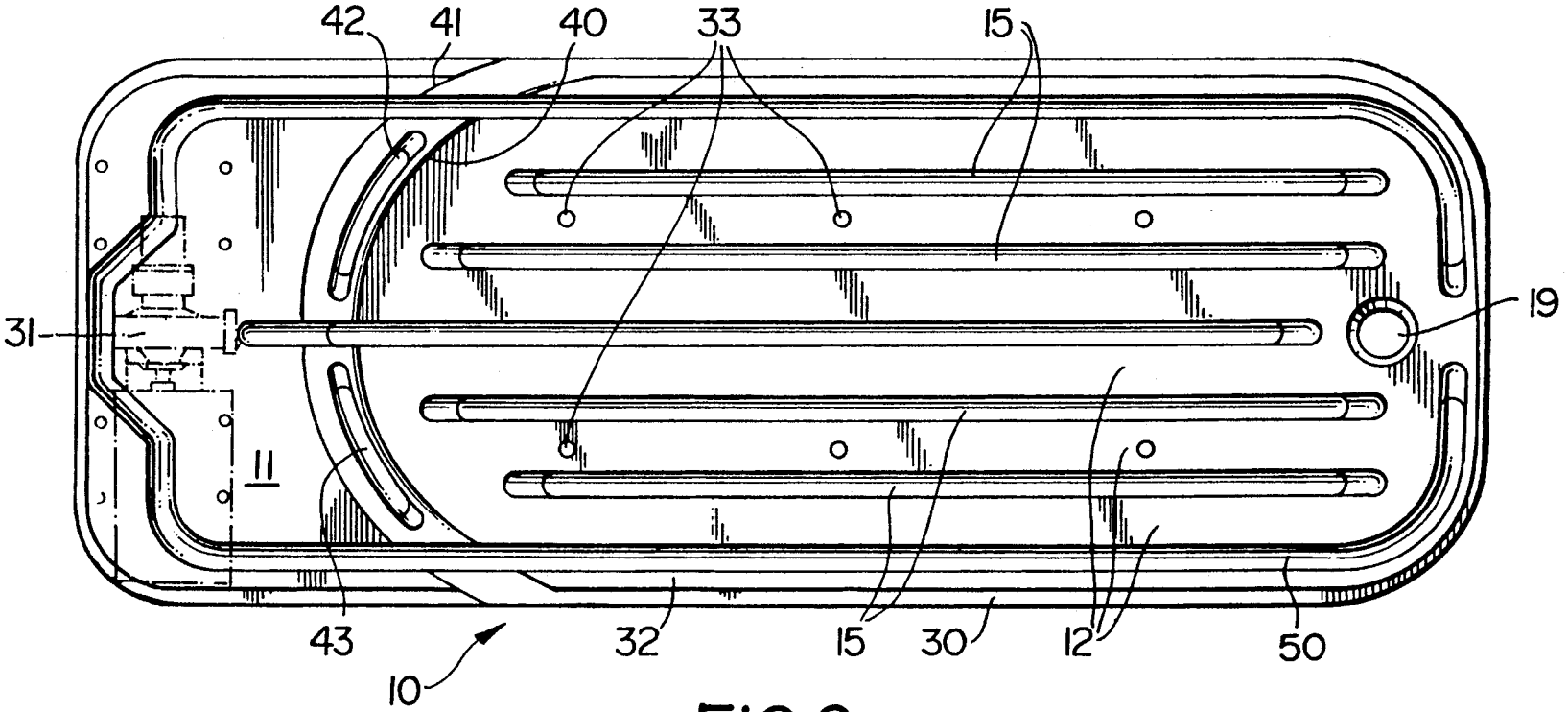
FIG. 6 is a top plan view of an enlarged support which has been extended to accommodate a circulation pump.

The major top surface 11 of the extended support 10 illustrated in FIG. 6, as in the case of the earlier described support, is provided with central contact area 12 created as a result of the previously described channel depressions 15 in the top surface of the support 10. As illustrated, the top surface also includes perimeter area 30 which cups the perimeter of the overlying basin (not shown) in a manner similar to area 13 of FIG. 1 through 5. A basin, such as a bathtub (not shown in FIG. 6), has its flat bottom portion terminating at one end of the spacer near aperture 19, and at its other, proximate a raised area in the surface of the support and which is shown by the two arcuately shaped lines 40 and 41 illustrated in the left hand side of FIG. 6. This raised area also includes arcuate floor engaging channels or depressions 42 and 43 disposed therebetween. As also illustrated in broken line, at 31, a circulation pump, such as a water pump can be mounted on the top surface of the spacer on a portion thereof which is exterior to that which is in surface contact with the underside of the basin, and hence, as illustrated in FIG. 6, is to the left of channels 42 and 43. It will be observed that but for top area contact surfaces 12, 30 and the raised area between lines 40 and 41 for the basin underside, a sizable surrounding cavity or channel 50 also can be created in the top surface 11 of the spacer, and which can be advantageously employed to accommodate air and/or water conduit located therein (not shown), or used as a collector channel for water leaks or condensation water drips from the pump or its associated water circulation conduits. Apertures 33 can also be located in the central area 12 of the support in order to permit air or water supply lines (not shown), to pass therethrough.

While not illustrated, but as previously mentioned, if the top face of the support which is contoured to receive the substantially flat bottomed portion of a basin is bonded to the underside of the basin, the parallel channel depressions 15, as seen in FIGS. 1 and 6 themselves can be advantageously used as sealed air or water circulation conduits which communicate with circulation apertures provided in the flat bottom portion of the basin (not shown) and which overlie these sealed channels.

I claim:

1. A spacer for nestingly receiving an underside portion of a water catchment basin and for supporting such a basin in a predetermined position above a horizontal base, said basin being of the type having a relatively flat and inclined bottom portion and an upwardly and outwardly curved sidewall portion surrounding said bottom portion, said spacer being of unitary construction and having major top and bottom exterior surfaces, said top exterior surface including a central top surface contact area and a top surface perimeter wall extending around said central top surface contact area, said bottom exterior surface including a central bottom surface contact area for engagement with said base and a bottom surface perimeter wall extending around said central bottom surface contact area, means for maintaining said central top surface contact area and said central bottom surface contact area in fixed spaced apart relationship, said means comprising an plurality of webs interconnecting said central top surface contact area to said central bottom surface contact area, said top surface perimeter wall and said central top surface contact area being dimensioned so as to supportingly engage and nestingly receive the underside of said flat bottom portion and the underside of said lower sidewall portion, and said bottom surface perimeter wall being contoured so as to generally conform with the dimensions of said lower curved sidewall portion of said basin so as to facilitate the placement of said spacer in a like basin and to enable like basins to be stacked one on top of the other in substantially non-contacting relationship.

2. The spacer as claimed in claim 1, wherein said webs are arranged in spaced apart pairs to form in the top exterior surface of said spacer a plurality of elongate channels which are located within said central top surface contact area.

3. The spacer as claimed in claim 2, wherein at least a portion of said top surface perimeter wall is spaced apart from said central top surface contact area by at least one channel depression in said top exterior surface and which is located between said top surface perimeter wall and said central top surface contact area.

4. The spacer as claimed in claim 3, wherein said central bottom surface contact area is formed by the bottom exterior surface of said elongate channels and said channel depression.

5. The spacer as claimed in claim 2, wherein the basin is an elongate bathtub and said elongate channels located in said central top surface contact area are arranged in parallel.

6. The spacer as claimed in claim 2, wherein said spacer includes an aperture which extends through aid top and bottom exterior surfaces of said support and which permits a drain pipe when attached to said basin to pass therethrough.

7. The spacer as claimed in claim 1 in combination with said basin and further including means for adhesively securing at least said central top surface contact area of said spacer to the underside of said flat bottom portion of said basin, said basin being selected from one of a bath tub, spa, hot tub and shower pan.

* * * * *